United States Patent [19]

Kako

[11] Patent Number: 5,040,515

[45] Date of Patent: Aug. 20, 1991

[54] APPARATUS FOR DETECTING THROTTLE OPENING OF AN ENGINE

[75] Inventor: Hajime Kako, Hyogo, Japan

[73] Assignee: Mitsubishi Denki Kabushiki Kaisha, Tokyo, Japan

[21] Appl. No.: 610,665

[22] Filed: Nov. 8, 1990

[30] Foreign Application Priority Data

Nov. 9, 1989 [JP] Japan ..... 1-293212

[51] Int. Cl.[5] ..... F02M 51/00

[52] U.S. Cl. ..... 123/494; 123/339; 123/480

[58] Field of Search ..... 123/494, 339, 492, 493, 123/480, 488

[56] References Cited

U.S. PATENT DOCUMENTS

| | | | |
|---|---|---|---|
| 4,844,042 | 7/1989 | Osano | 123/492 |
| 4,903,658 | 2/1990 | Miyawa et al. | 123/339 |
| 4,903,660 | 2/1990 | Sogawa | 123/339 |
| 4,911,133 | 3/1990 | Sogawa | 123/494 |
| 4,960,097 | 10/1990 | Tachibara et al. | 123/494 |
| 4,967,715 | 11/1990 | Nosaka | 123/494 |
| 4,982,709 | 1/1991 | Oota | 123/339 |

FOREIGN PATENT DOCUMENTS

| | | | |
|---|---|---|---|
| 62-13503 | 3/1987 | Japan | 123/494 |

*Primary Examiner*—Raymond A. Nelli

*Attorney, Agent, or Firm*—Sughrue, Mion, Zinn, Macpeak and Seas

[57] ABSTRACT

An apparatus for detecting the degree of opening of a throttle valve of an engine. A first value indicating the degree of opening of the throttle valve and a second value indicating the opening of the throttle valve in an idling position are detected and stored. Whether the first value is kept unchanged for a fixed interval is decided when the throttle valve is in an idling position. A stable value of the first values is provided when the first value is kept unchanged for a fixed interval and the throttle valve is in an idling position. Then the second value is updated to the stable value. A value indicating the difference between the stored first and second values is calculated. The calculated value is used to control the amount of fuel supplied to the engine.

9 Claims, 10 Drawing Sheets

DETECT I.P. REFERENCE-THROTTLE OPENING VALUE θ
θADC ≦ θmax ?
S10
N
Y
θSTB≦θADC≦θSTB+1 ?
S20
Y
N
100MS PRESET TIMING ?
S14
N
Y
30 → TM
S12
θABC → θSTB
S13
S15
DECREMENT TIMER (min 0)
TM = 0 ?
S16
N
Y
θSTB < θIDL ?
S30
N
Y
θSTB → θIDL
S17
θSTB < θLOW ?
S31
N
Y
θSTB → θLOW
S32
θLOW = 255 ?
S40
θLOW = θLOWP ?
S41
Y
N
3 → CNT
S42
θLOW → θLOWP
S43
DECREMENT COUNTER(min0)
S44
CNT = 0 ?
S45
N
Y
θLOWP → θIDL
S46
255 → θLOW
S47
θADC − θIDL → θ
S18
RETURN DETECT I.P. REFERENCE-THROTTLE OPENING VALUE θ
θADC ≤ θmax ?
S10
N
Y
θSTB≤θADC≤θSTB+1 ?
S20
Y
N
100MS PRESET TIMIG ?
S14
30 → TM
S12
θADC → θSTB
S13
S15
DECREMENT TIMER (min 0)
TM = 0 ?
S16
θSTB < θIDL ?
S30
θSTB → θIDL
S17
θSTB < θLOW ?
S31
θSTB → θLOW
S32
θADC < θMIN ?
S50
θADC → θMIN
S51
θADC − θIDL → θ
S18
RETURN
θLOW = 255 ?
S40
θLOW = θMIN ?
S52
θLOW = θLOWP ?
S41
3 → CNT
S42
θLOW → θLOWP
S43
DECREMENT COUNTER (min 0)
S44
CNT = 0 ?
S45
θLOWP → θIDL
S46
255 → θLOW
S47
255 → θMIN
S53

APPARATUS FOR DETECTING THROTTLE OPENING OF AN ENGINE

BACKGROUND OF THE INVENTION

1. Field of the Invention

The present invention relates to an apparatus for detecting the degree of throttle opening of an engine and which is capable of detecting the degree of opening of a throttle valve when an engine is idling ("the idling position").

2. Prior Art

It is known that an amount of fuel supplied, ignition timing, an amount of air bypassed and so on are controlled on the basis of a detection of the degree of opening of a throttle of an engine. For example, when an intake air sensor fails to function properly, an output of such a sensor is switched to a false signal calculated on the basic of a throttle opening signal corresponding to the degree of opening of a throttle valve, and a rotational frequency signal corresponding to the rotational frequency of an engine, and this false signal is used to calculate a necessary amount of fuel to be supplied by a well known calculating proceduce (cf. Japanese Patent Public Disclosure No. 13503/87).

By using a signal made with reference to an idling position (the zero position) of an engine as a throttle opening signal for controlling an amount of fuel supplied, ignition timing, an amount of air bypassed and so on, it may be possible to absorb the offset of a signal corresponding to the degree of opening of a throttle determined by the amount of intake air at the idling state, and to achieve optimum control with a high degree of accuracy.

A potentiometer is usually used for outputting an electrical signal corresponding to a throttle valve position as a detector which outputs a signal corresponding to an amount of throttle opening. Such a potentiometer operates to divide a voltage applied across the potentiometer and output a voltage corresponding to various positions from the idling position to the fully opened position. Conventionally, in order to accomplish optimum control with a high degree of accuracy, the position of such a detector is adjusted during a manufacturing process so that the detector may output a predetermined reference voltage. A throttle opening detector outputs the difference between an output signal of the detector and the predetermined reference voltage as a signal indicating an amount of throttle opening. On the basis of such amount of throttle opening, a control unit operates to control the amount of fuel suppliesd, ignition timing, the amount of air bypassed, and so on.

Since a conventional apparatus for detecting the amount of throttle opening of an engine is consituted as described above, the degree of control precision decreases in a case where positional deviation occurs during manufacture of a car, where a position at which a detector is mounted deviates due to prolonged usage of the detector, or where an idling position is changed in order to adjust the number of engine rotations when idling. For example, in the case of controlling an amount of fuel supplied, an output voltage of a detector at the throttle valve position during operation becomes lower than a normal value when the output voltage of the detector at an idling position becomes lower than a reference voltage. Accordingly, the amount of fuel supplied is reduced, the air/fuel ratio becomes lean and idling stability and the drivability deteriorates.

SUMMARY OF THE INVENTION

It is an object of the invention to provide an apparatus for detecting the degree of opening of a throttle valve and which is capable of outputting an exact throttle opening signal with reference to the idling position (the zero position) even when a voltage output from a sensor indicating an idling position is changed due to a change in the idling position and dispersion in the adjustment of sensors.

In order to achieve the above-described object, the present invention provides an apparatus for detecting the degree of opening of a throttle valve of an engine, comprising:

- means coupled to the throttle valve for providing a first signal indicating the degree of opening of the throttle valve;
- means for detecting the degree of opening of the throttle valve during idling so as to provide a second signal indicating such a state; and
- means for calculating a value indicating the difference between the first and second signals, whereby the calculated value is used to control an amount of fuel supplied to the engine.

The first embodiment of an apparatus for detecting the degree of opening of a throttle valve of an engine according to the present invention comprises:

- a first storing means for storing a first value indicating the degree of opening of the throttle valve;
- a second storing means for storing a second value indicating the degree of opening of the throttle valve during idling;
- means for deciding whether the throttle valve is in an idling position;
- means for deciding whether the first value is kept unchanged for a fixed interval when it has been decided that the throttle valve is in an idling position;
- means for providing a stable value of the first value when it is decided that the first value is kept unchanged for a fixed interval and that the throttle valve is in an idling position;
- means for causing the second storing means to update the second value to the stable value; and
- means for calculating a value indicating the difference between the contents of the first and second storing means, whereby the calculated value is used to control an amount of fuel supplied to the engine.

The second embodiment of an apparatus for detecting the degree of opening of a throttle value of an engine according to the present invention includes in addition to the construction of the first embodiment:

- means for detecting and providing the minimum value of the stable values detected during the period in which the throttle valve is in idling position;
- means for detecting whether the minimum value of the stable values is kept unchanged for a fixed interval when the throttle valve is not in an idling position; and
- means for causing the second storing means to update the second value to the minimum value of the stable values when it is decided that the minimum value of the stable values is kept unchanged for the fixed interval when the throttle valve is not in an idling position.

The second embodiment of the present invention may further comprise:

means for deciding whether the lower limit of the first value is lower than the second value; and means for causing the second storing means to update the second value to the lower limit of the first value.

The second embodiment of the present invention may still further comprise:

means for detecting and providing the minimum value of the first values during the period in which the throttle valve is in an idling position;

means for deciding whether the minimum value of the stable values is kept equal to the minimum value of the first value for a fixed interval; and means for causing the second storing means to update the second value to the minimum value of the stable values when it is decided that the minimum value of the stable values is kept equal to the minimum value of the first values for the fixed interval.

In accordance with the third embodiment of the present invention, means for deciding whether the first value is kept within a predetermined range for a fixed interval when the throttle valve is in an idling position is incorporated into the construction of the second embodiment. This enables the means for providing a stable value to provide the lower limit of the first value and the second storing means to be updated to such a lower limit when it is decided that the first value is kept within the predetermined range for the fixed interval when the throttle valve is in an idling position.

The third embodiment of the present invention may further comprise:

means for detecting and providing the minimum value of the stable values detected during the period in which the throttle valve is in an idling position;

means for deciding whether the minimum value of the stable values is kept unchanged for a fixed interval when the throttle valve is not in an idling position; and means for causing the second storing means to update the second value to the minimum value of the stable values when it is decided that the minimum value of the stable values is kept unchanged for the fixed interval when the throttle valve is not in and idling position.

The third embodiment of the present invention may still further comprise:

means for deciding whether the lower limit of the first value is lower than the second value; and means for causing the second storing means to update the second value to the lower limit of the first value.

The fourth embodiment of the present invention comprises in addition to the construction of the third embodiment:

means for detecting and providing the minimum value of the first values during the period in which the throttle valve is in an idling position;

means for deciding whether the minimum value of the stable values is kept equal to the minimum value of the first values for a fixed interval; and means for causing the second storing means to update the second value to the minimum value of the stable values when it is decided that the minimum value of the stable values is kept equal to the minimum value of the first values for the fixed interval.

The above and other features, objects and advantages of the invention will become clearer from the following description taken in connection with the accompanying drawings.

DESCRIPTION OF THE PREFERRED EMBODIMENTS

Figure 1:
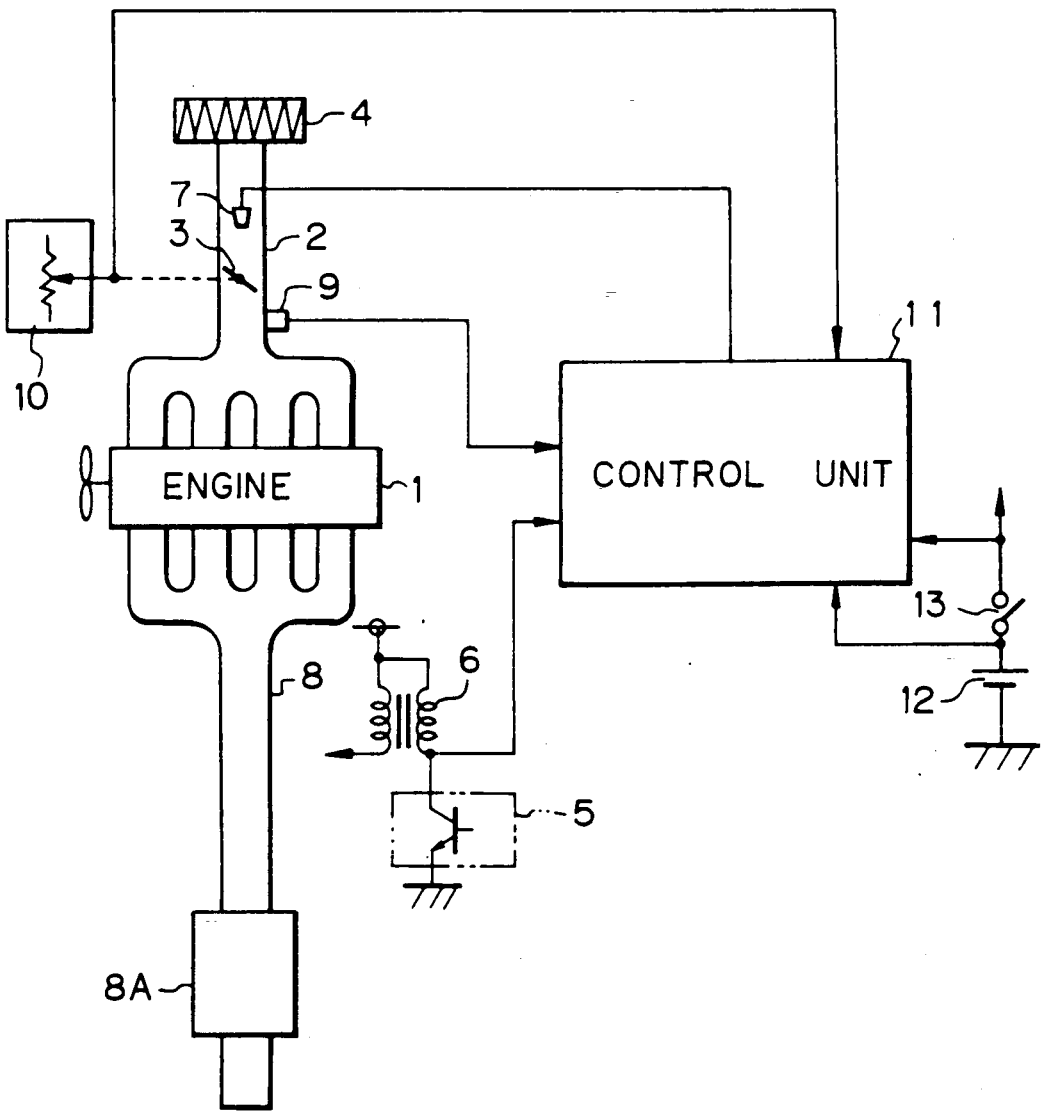
FIG. 1 schematically shows an engine electrically controlled by an apparatus for detecting the degree of opening of a throttle valve according to the present invention.

FIG. 1 schematically shows an engine electrically controlled by an apparatus for detecting the degree of throttle opening according to the present invention. In this figure, an engine 1 mounted in an automobile intakes air through an intake pipe 2 and a throttle valve 3 from an air cleaner 4. At the time of ignition, an igniter 5 is turned from a ON to OFF position by a signal from a signal generator (not shown) in a distributor. When the igniter 5 is turned off, a high voltage ignition signal is generated at a secondary winding of an ignition coil 6 and supplied to a spark plug (not shown). In synchronism with the occurrence of this ignition signal, fuel is injected from an injector 7 to the intake pipe 2 located upstream of the throttle valve 3, and the injected fuel is taken into the engine 1 by the above-described intake operation. An exhaust gas produced after the fuel combusted is discharged through an exhaust manifold 8 and a three-way catalytic converter 8A to the atmosphere.

The pressure in the intake pipe 2 downstream of the throttle valve 3 is detected as the absolute pressure by a pressure sensor 9. An analog pressure detection signal proportional to the detected absolute pressure, an analog throttle opening signal proportional to the degree of throttle opening detected by a throttle sensor 10 and an ignition signal generated at a primary winding of the ignition coil 6 are supplied to a control unit 11.

The control unit 11 receives electric power from a battery 12 when a key switch 13 is turned ON, performs the operations of the routine shown in FIG. 3 (explained later) and calculates the amount of fuel to be injected in accordance with a driving state of the engine 1 in order to control the degree of opening of a valve of the injector 7.

Figure 2:
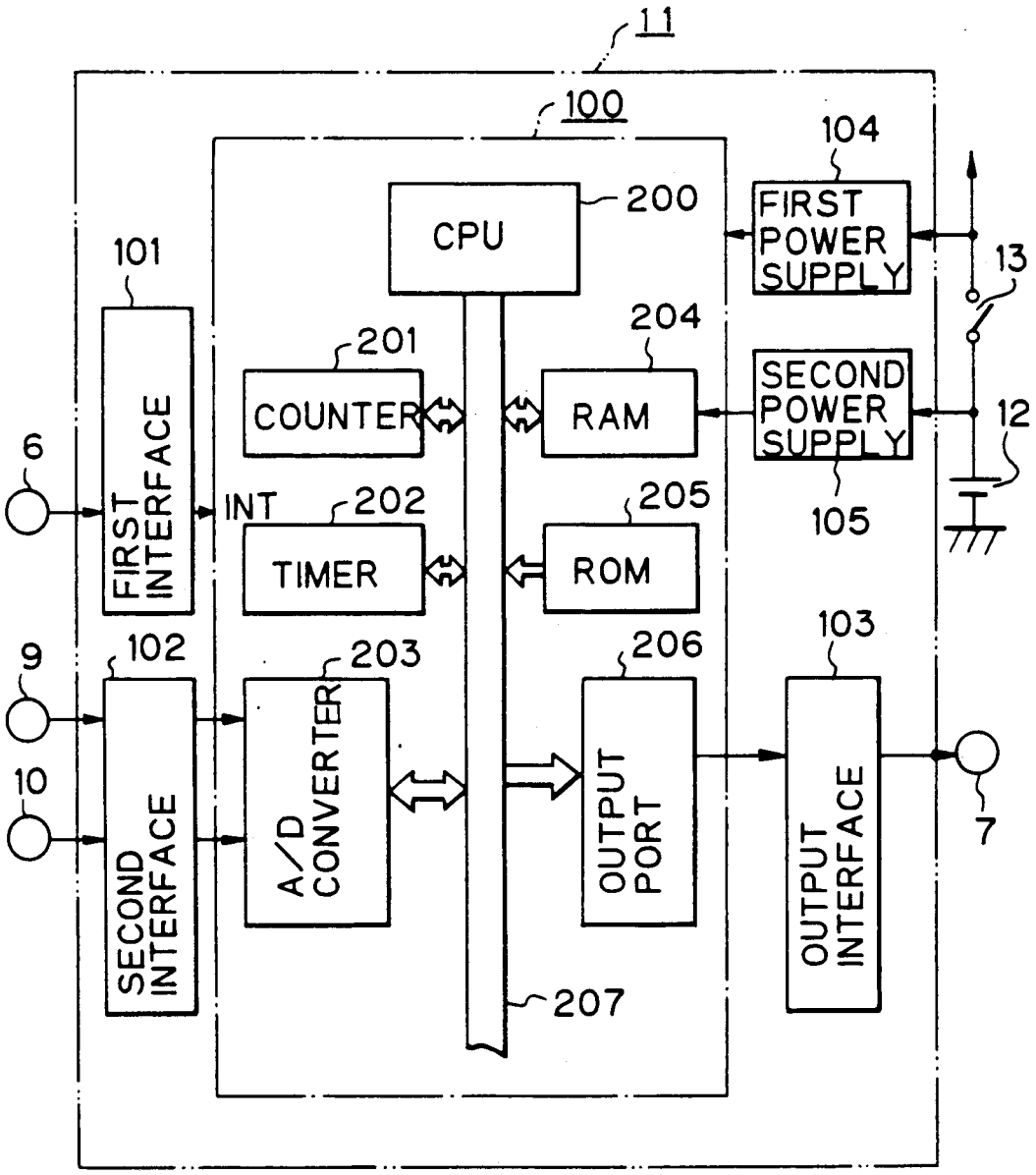
FIG. 2 is a block diagram showing an example of the structure of a control unit of FIG. 1.

FIG. 2 is block diagram showing an example of the structure of the control unit 11. In the figure, the control unit 11 has a microcomputer 100 which comprises a CPU 200, a counter 201 for measuring an ignition signal period, a timer 202, an A/D converter 203, a non-volatile RAM 204 operating as a work memory for storing various values such as the degree of throttle opening in an idling position, a ROM 205 for storing programs explained later with reference to FIG. 3, an output port 206 and a bus 207.

An ignition signal generated at the primary winding of the ignition coil 6 is shaped by an input interface circuit 101 and fed to the microcomputer 100 as an interrupt input. At the time of such interruption, an ignition signal period measured by the counter 201 is read out and stored in the RAM 204 for detecting the number of engine rotations. Output signals of the pressure sensor 9 and the throttle opening sensor 10 are formed by a second input interface circuit 102 which serves to eliminate noise from these output signals. The shaped and noise-free signals are A/D converted in sequence by the A/D converter 203. An amount of injected fuel is calculated as the length of time when the injector 7 is open in accordance of the state of driven engine and set to timer 202. During the period when the timer 202 operates, the output port 206 outputs a voltage of a predetermined level. This voltage is converted to an electric current value by an output interface 103 and serves to open the valve of the injector 7 which causes fuel to be supplied from the injector 7.

The microcomputer 100 receives electric power from a first power supply 104 to which the battery 12 is connected through the key switch 13. A second power supply 105 is connected to the battery 12 at all times to serve as a backup power supply for inhibiting the content of the RAM 204 from being erased.

An operation of the CPU 200 according to the present invention will next be explained with reference to a flowchart shown in FIG. 3. In step S1, a value Ne indicating a rotational frequency of the engine is calculated from a measured period of the ignition signal from the ignition coil 6, and stored in the RAM 204. In step S2, an analog output signal of the pressure sensor 9 is A/D converted by the A/D converter 203 and stored in the RAM 204 as an intake pipe pressure value Pb which indicates a digital value obtained by A/D converting an intake pipe pressure. In step S3, a signal output from the throttle opening sensor 10 is A/D converted by the A/D converter 203 to a throttle opening value $\theta_{ADC}$ which indicates a digital value obtained by A/D converting the degree of throttle opening correspondingly. In step S4, a process of detecting a throttle opening value with reference to an idling position ("idling position reference-throttle opening value") $\theta$ is effected as shown in detail in FIGS. 5, 6, 8 and 10.

Next, in step S5 a decision is made as to whether the pressure sensor 9 is operating normally, that is, whether intake pipe pressure value Pb is within a predetermined normal range ($Pb_{min} \leqq Pb \leqq Pb_{max}$). If the pressure sensor 9 is operating normally, intake pipe pressure value Pb is stored in the RAM 204 as a pressure value for operation Pb' in step S6. If step S5 decides that intake pipe pressure value Pb is outside the predetermined range and is abnormal, the program proceeds to step S7. In step S7, a false signal $f(Ne,\theta)$ is calculated as a false pressure value of an intake pipe pressure using rotational frequency Ne and idling position reference-throttle opening value $\theta$, and stored in the RAM 204 as a pressure value for operation Pb'.

Figure 4:
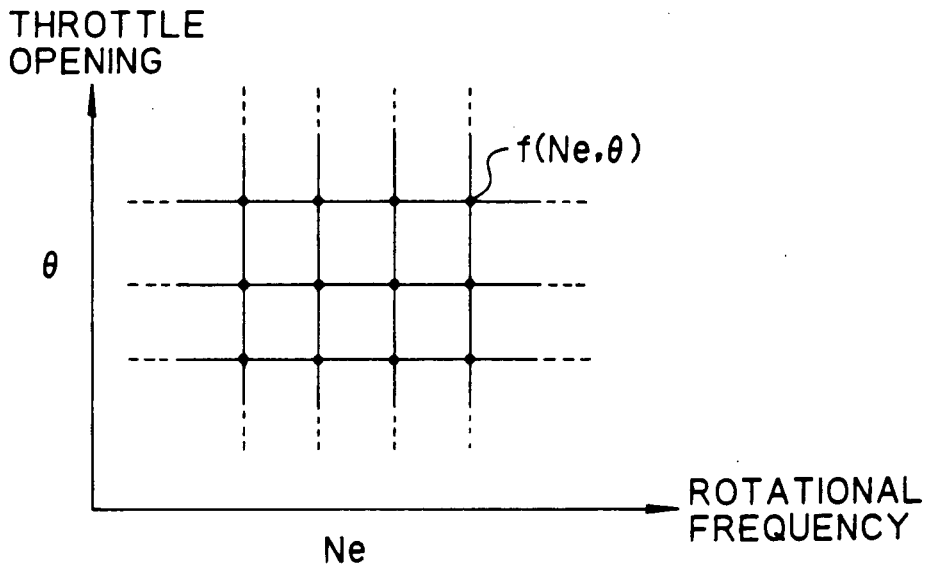
FIG. 4 is a graph showing a two-dimensional map stored in a ROM shown in FIG. 2 for obtaining a false signal f (Ne,$\theta$)

False signals $f(Ne,\theta)$ have been obtained from experiments as intake pipe pressure values sent from the pressure sensor 9 in accordance with rotational frequency values Ne and idling position reference-throttle opening values $\theta$, and have been stored in the ROM 205 as a two-dimensional map as shown in FIG. 4.

In step S8, a volumetric efficiency $C_{EV}(Ne,Pb')$ is calculatee from rotational frequency Ne and pressure value for operation Pb'. $C_{EV}(Ne,Pb')$ has been experimentally obtained in correspondence to Ne and Pb' for predetermined air/fuel ratios in the form of a two-dimensional map stored in the ROM 205. In step S9, a pulse width $T_{PW}$ is calculated as an amount of fuel injected in accordance with the following equation:

$$T_{PW} = K \times Pb' \times C_{EV}$$

where K is a constant. The calculated $T_{PW}$ is stored in the RAM 204. Then the program returns to step S1 and repeats the steps described above. The calculated $T_{PW}$ is set in the timer 202 in synchronism with the occurrence of an ignition signal and causes the timer 202 to operate for the duration of $T_{PW}$.

Figure 3:
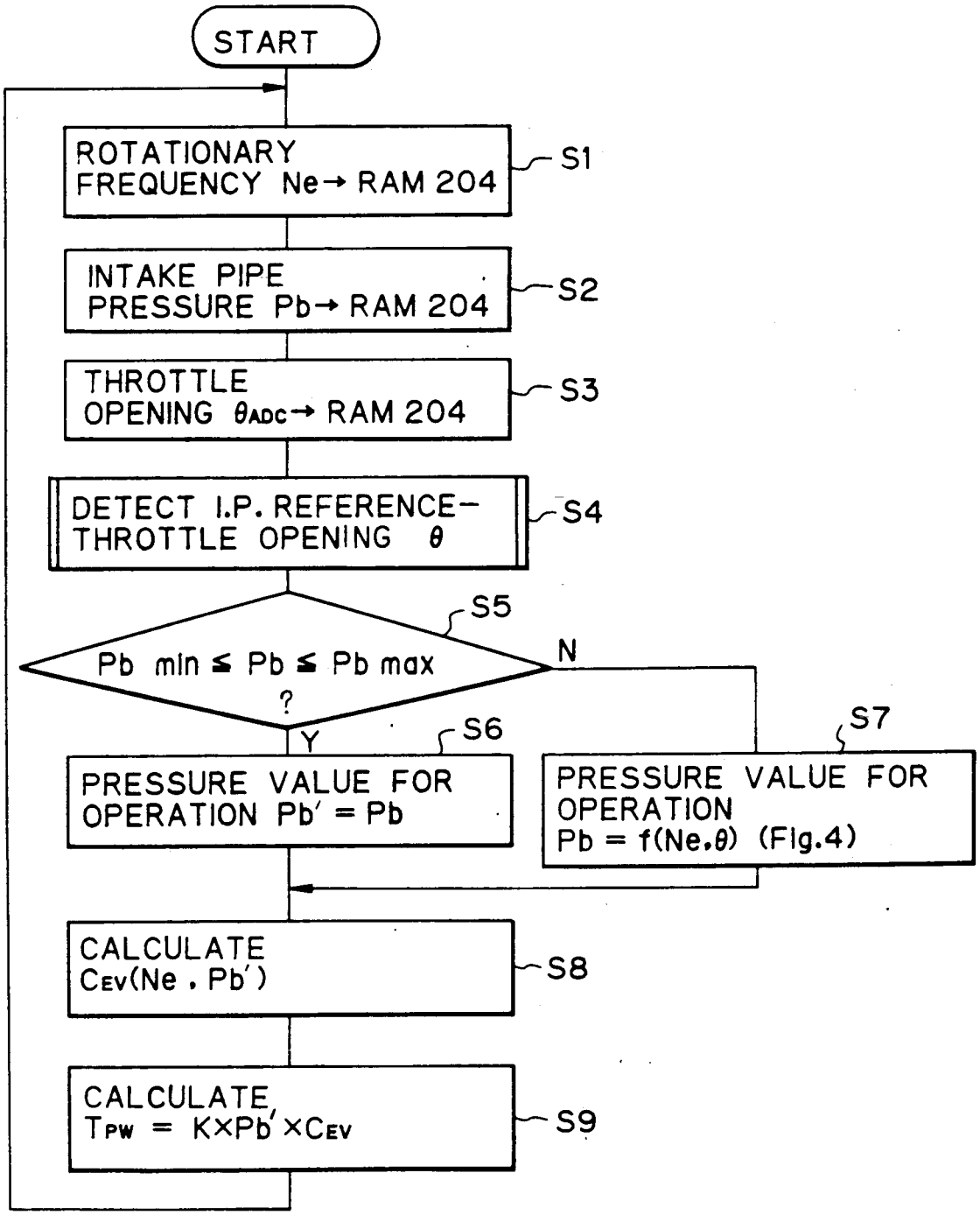
FIG. 3 shows a flowchart of the operations for controlling an amount of fuel supplied to the engine.

The present invention relates to operations performed in the step S4 shown in FIG. 3 for detecting idling position reference-throttle opening $\theta$. The first embodiment of the present invention will be explained with reference to FIG. 5. In this figure, a decision is made in step S10 as to whether throttle opening value $\theta_{ADC}$ is equal to or smaller than a predetermined value $\theta_{max}$ which is taken as the upper limit of the throttle opening value $\theta$ADC when the throttle valve is in an idling position taking into consideration a deviation in the mounting position of the throttle opening sensor 10 and the idling position. $\theta_{max}$ has been stored in the ROM 205 beforehand.

If $\theta_{ADC} \leqq \theta_{max}$, indicating that there is the possibility of the throttle valve 4 being in an idling position, the program proceeds to step S11 where a decision is made as to whether throttle opening value $\theta_{ADC}$ is equal to a stable value $\theta_{STB}$. If $\theta_{ADC}$ is unequal to $\theta_{STB}$, the timer TM is set to thirty (corresponding to three seconds) in step S12. In step S13, $\theta_{STB}$ is updated to the current throttle opening value.

If $\theta_{ADC} = \theta_{STB}$ in step S11, a decision is made in step S14 as to whether the current point of time coincides with any one of timings preset at an interval of 100 miliseconds. If NO, the program jumps to step S16. On the other hand, if YES, the timer TM is decremented by one in step S15 if TM is unequal to zero. However, if the timer TM is equal to zero, nothing is done in step S15.

As a result of operations in S11–S15, if no change in throttle opening value $\theta_{ADC}$ has been found more than thirty consecutive times, that is, for more than three consecutive seconds, the timer TM becomes equal to zero and throttle opening value $\theta_{ADC}$ at this time is set to stable value $\theta_{STB}$ and stored in the RAM 204. In step S16, a decision is made as to whether the timer TM is equal to zero. If YES, indicating that throttle opening value $\theta_{ADC}$ has not changed more than three seconds, a throttle opening value in an idling position ("idling position throttle opening value") $\theta_{IDL}$ is updated to stable value $\theta_{STB}$ in step S17. After the operation in step S17 has been completed, when the timer TM is not equal to zero in step S16 and when $\theta$ADC $>\theta_{max}$ in step S10, idling position reference-throttle opening value $\theta$is updated in step S18 to a value equal to ($\theta_{ADC}$-$-\theta$IDL).

Figure 6:
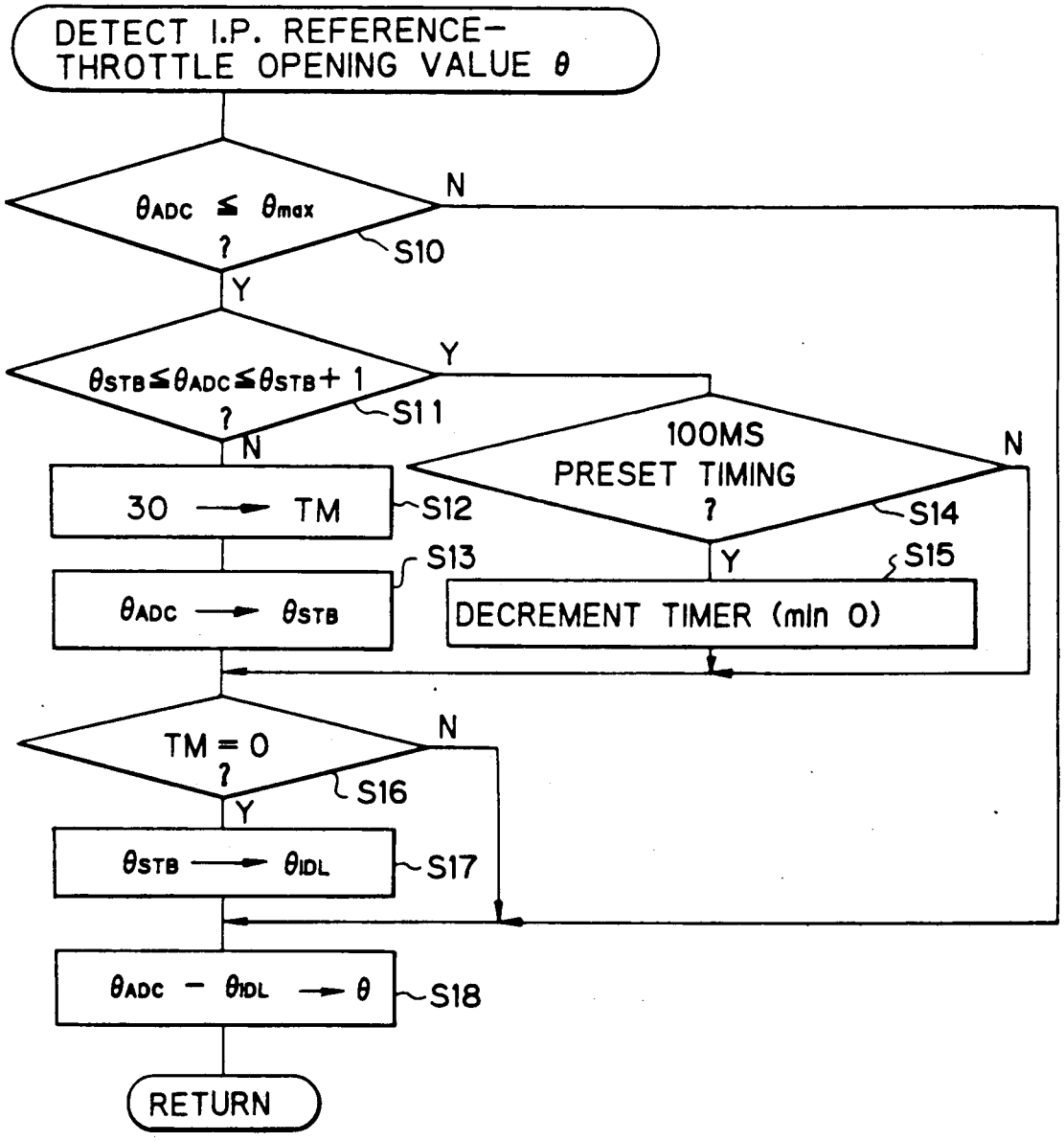
FIG. 6 shows a flowchart of the operations for detecting an idling position reference-throttle opening value in accordance with the seond embodiment of the present invention.

FIG. 6 shows the second embodiment of the operation performed in the step S4 in accordance with the present invention. This embodiment is different from the first one in that step S20 is executed instead of step S11, and therefore explanation of the remaining steps is omitted here. When it is decided in step S10 that $\theta_{ADC}$ is equal to or smaller than $\theta_{max}$, a decision is made in step S20 as to whether throttle opening value $\theta_{ADC}$ is equal to or larger than stable value $\theta_{STB}$ but equal to or smaller than $\theta_{STB}+1$ bits. If $\theta_{ADC}$ is outside this range, steps S12 and S13 are executed. If $\theta_{ADC}$ within the range, steps S14 and S15 are executed.

As a result of the operations in steps S20 and S12–S15, if it is decided that the change in throttle opening value $\theta_{ADC}$ is within $$\begin{matrix}+1\\-0\end{matrix}\ \text{bit}$$

for more than three consecutive seconds, the timer TM becomes equal to zero and the lower limit of $\theta_{ADC}$ is stored as a stable value $\theta_{STB}$. Accordingly, if it is decided that the timer TM is equal to zero in step S16, idling position throttle opening value $\theta_{IDL}$ is updated to the above-described $\theta$STB in step S17. After the completion of step S17, if it is decided in step S10 that $\theta_{ADC}>\theta_{max}$ and if it is decided in step S16 that the timer TM is unequal to zero, idling position reference-throttle opening value $\theta$ is updated to ($\theta_{ADC}-\theta_{IDL}$) in step S18.

Figure 7:
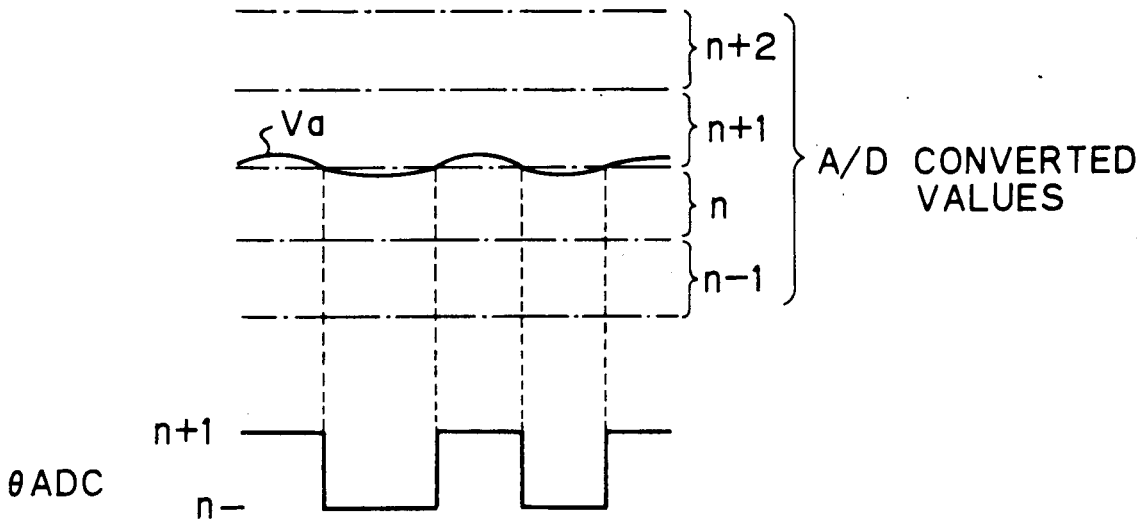
FIG. 7 shows a relation between an output voltage of a throttle opening sensor and A/D converted value thereof in the second embodiment.

In the operation performed in the second embodiment, an output voltage Va of the throttle opening sensor 10 when the throttle valve is in an idling position is, as shown in FIG. 7, in the vicinity of a boundary of the corresponding A/D converted value output from the A/D converter 203. Accordingly, even if A/D converted throttle opening value $\theta_{ADC}$ varies within the range of $$\begin{matrix}+1\\-0\end{matrix}\ \text{bit}$$

due to noise and voltage fluctuation in the electricity supply, it is still possible to detect an idling position of the throttle valve.

Figure 8:
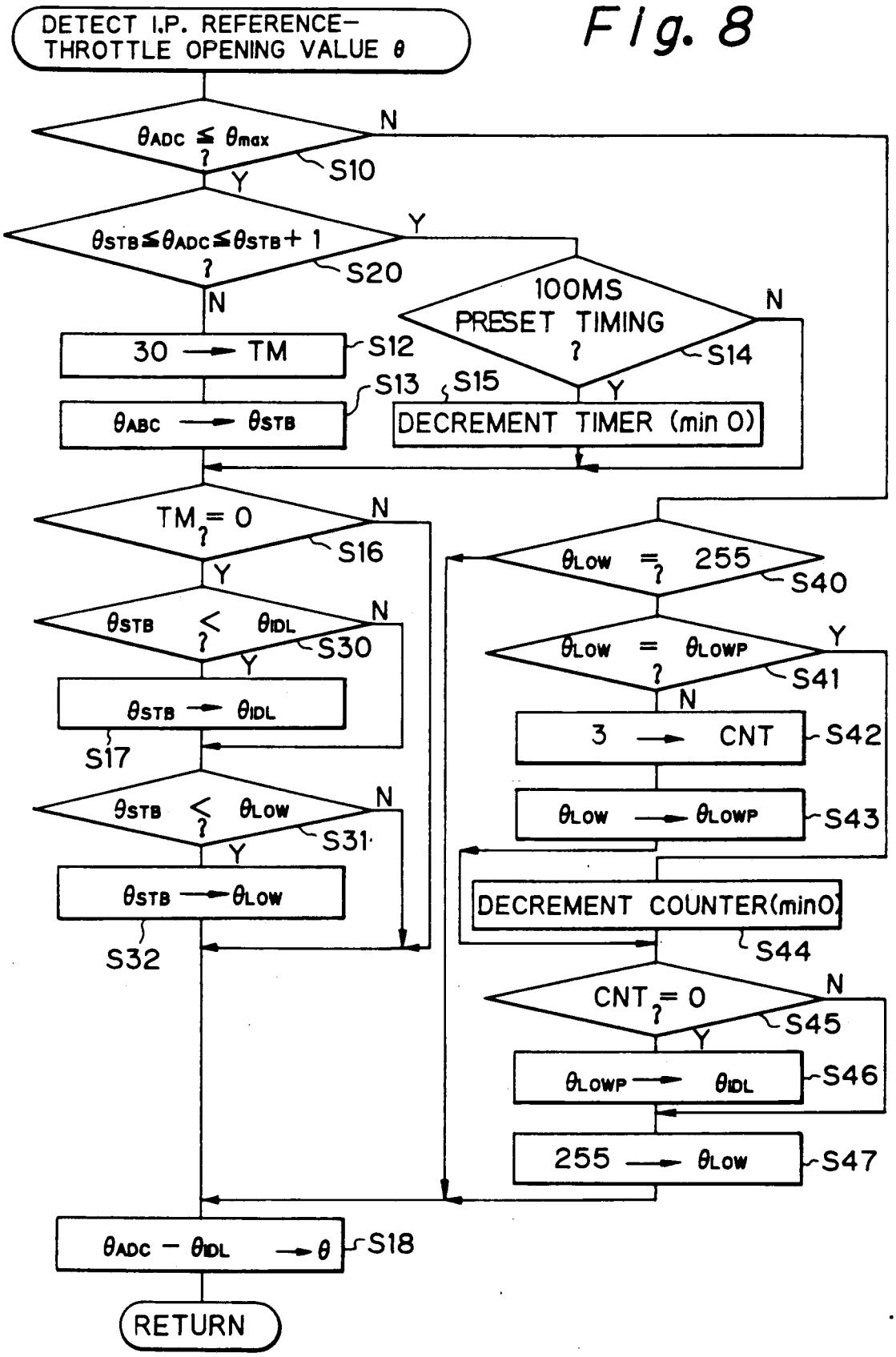
FIG. 8 shows a flowchart of the operations for detecting an idling position reference-throttle opening value in accordance with the third embodiment of the present invention.

FIG. 8 shows the third embodiment of the step S4 (FIG. 3) according to the present invention. In the third embodiment, steps S30–S32 and S40–S47 are incorporated into the steps of the second embodiment shown in FIG. 6. In FIG. 8, operations similar to those in FIG. 6 are designated by the same reference symbols and explanation thereof is omitted here. When it is decided in step S10 that throttle opening value $\theta_{ADC}$ does not exceed predetermined value $\theta_{max}$, stable value $\theta_{STB}$ is obtained in steps S20 and S12–S15 and it is decided in step S16 that the timer TM is equal to zero, a decision is made in step S30 as to whether stable value $\theta_{STB}$ already obtained is smaller than idling position throttle opening value $\theta_{IDL}$. If NO, the program jumps to step S31, and if YES, $\theta_{IDL}$ is updated to stable value $\theta_{STB}$ in step S17.

In step S31, a decision is made as to whether stable value $\theta_{STB}$ is smaller than a minimum stability value $\theta_{LOW}$ which is the lowest of the stable values. If NO, the program jumps to step S18. If YES, $\theta_{LOW}$ is updated to $\theta_{STB}$ in step S32. Since minimum stability value $\theta_{LOW}$ has been set to the maximum value 255 in step S47 (explained later) when throttle opening value $\theta_{ADC}$ is larger than predetermined value $\theta_{max}$, minimum stability value $\theta_{LOW}$ is the minimum value of $\theta_{STB}$ during the period in which throttle opening value $\theta_{ADC}$ is continuously equal to or smaller than predetermined value $\theta_{max}$.

In step S10, if it is decided that throttle opening value $\theta_{ADC}$ is larger than perdetermined value $\theta_{max}$, a decision is made in step S40 as to whether minimum stability value $\theta_{LOW}$ is equal to 255. If YES, the program jumps to step S18. If NO, indicating that $\theta_{LOW}$ has been updated during the period when $\theta_{ADC}$ is smaller than $\theta_{Max}$ and that steps S41–S46 explained later have not yet been executed, in step S41, a decision is made as to whether the minimum stability value at the present time is equal to that at the preceeding time $\theta_{LOWP}$. If NO, a counter CNT is set to three in step S42 and $\theta_{LOWP}$ is updated to $\theta$LOW in step S43. If YES, the counter CNT is decremented by one in step S44 if the counter CNT is not equal to zero. If the counter CNT is equal to zero, nothing is done in step S44.

As a result of the operations in steps S41–S44, if a decision that the minimum stability value at the present time is equal to that at the preceeding time is made more than three consecutive times, the counter CNT becomes equal to zero and the minimum stability value at this time is stored in the RAM 204 in place of the minimum stability value at the preceeding time. Then, in step S45, a decision is made as to whether the counter CNT is equal to zero. If NO, the program jumps to step S47. If YES, indicating that the decision that the minimum stability value at the present time is equal to that at the preceeding time is made more than three consecutive times, idling position throttle opening value $\theta_{IDL}$ is updated to $\theta_{LOWP}$ in step S46. Next, in step S47, minimum stability value $\theta_{LOW}$ is set to the maximum value 255 for the preparation of the next detection of the minimum stability values and for indicating that the operations in steps S40–S46 have been completed.

After the completion of the operation of step S47, if it is decided in step S40 that $\theta_{LOW}$ is equal to 255, if it is decided in step S16 that the timer TM is not equal to zero, and if it is decided in step S31 that $\theta_{STB}\geqq\theta_{LOW}$, and after the completion of the operation in step S32, idling position reference-throttle opening value $\theta$ is updated to ($\theta_{ADC}-\theta_{IDL}$) in step S18.

Figure 9:
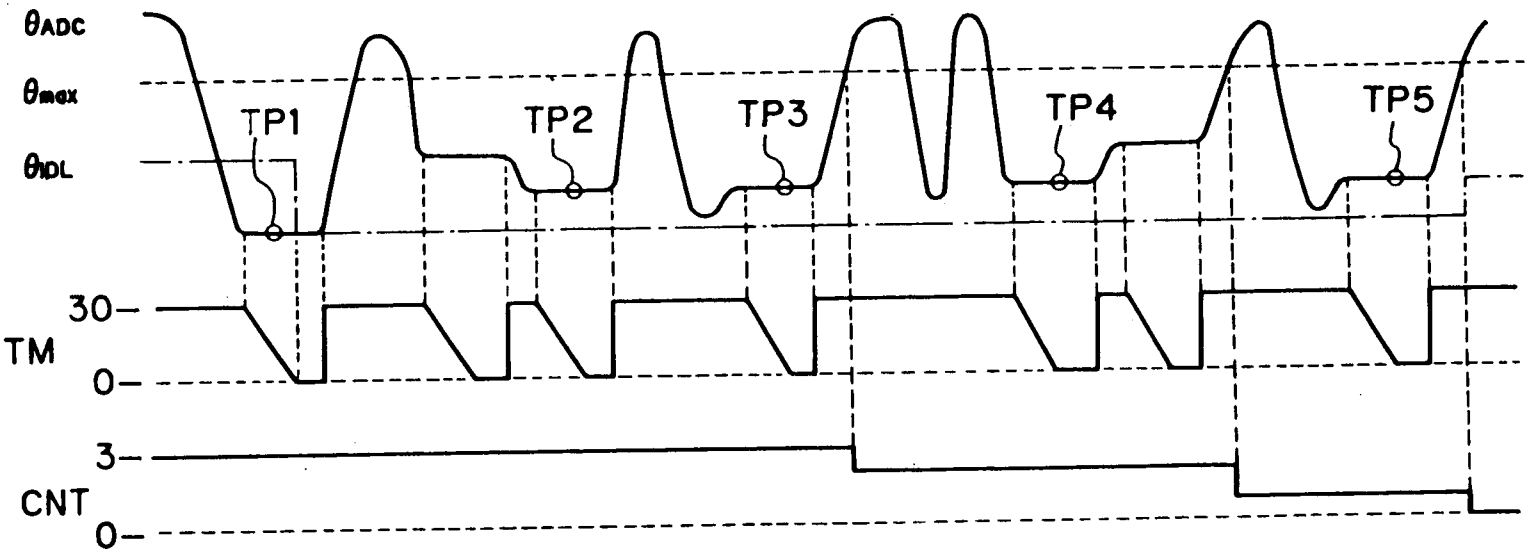
FIG. 9 shows a graph used for explaining the operation of the third embodiment.

FIG. 9 shows a time chart for explaining the operation of the control unit in accordance with the third embodiment described above. In this figure, the reference symbols TP1–TP5 designate throttle valve positions in different times, throttle valve positions TP2–TP5 being the same but different from throttle valve position TP1. Even if the throttle valve 3 (FIG. 1) is kept slightly open and stabilized in that position, only if the throttle valve 3 assumes the same slightly opened position four consecutive times as designated by TP2–TP5 in FIG. 9, does counter CNT become equal to zero and the idling position throttle opening value $\theta_{IDL}$ be updated. Accordingly, it is possible to significantly reduce the possibility of an error occurring in detecting an idling position of the throttle valve.

Figure 10:
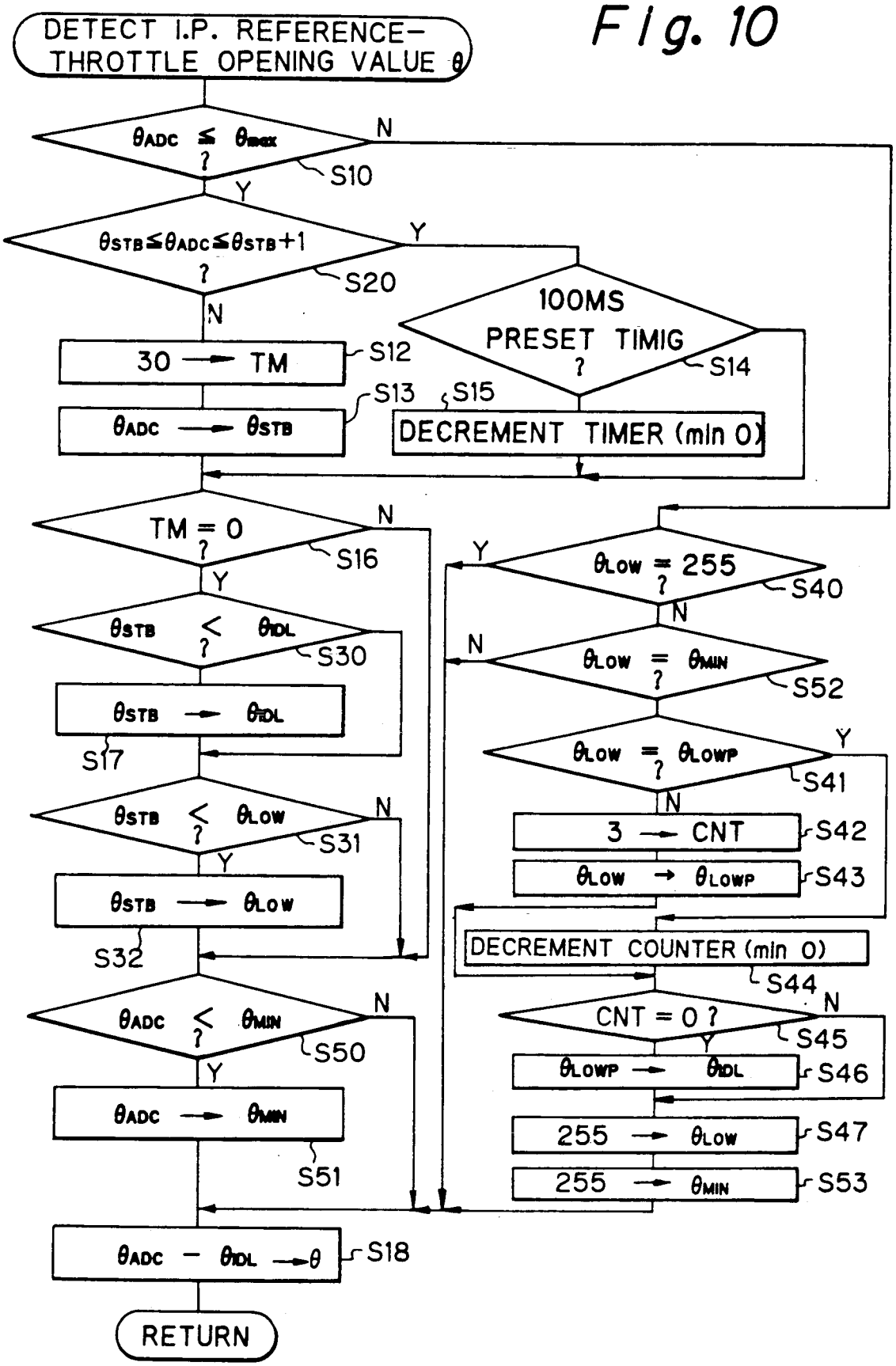
FIG. 10 shows a flowchart of the operations for detecting an idling position reference-throttle opening value in accordance with the fourth embodiment of the present invention.

The further embodiment of the step S4 according to the present invention will now be explained with reference to FIG. 10. As seen from this figure, now steps S50–S53 are added to the steps of the third embodiment, and therefore explanation will focus on the operation of these new steps.

If it is decided in step S10 that throttle opening value $\theta_{ADC}$ does not exceed predetermined value $\theta_{max}$, stable value $\theta$STB is obtained in steps S20 and S12–S15. If it is decided in step S16 that the timer TM is equal to zero, idling position throttle opening value $\theta_{IDL}$ is updated to stable value $\theta_{STB}$ in step S17 if it is decided in step S30 that $\theta_{STB}$ is smaller than $\theta_{IDL}$. Then, minimum stability value $\theta_{LOW}$ is obtained in steps S31 and S32.

After those operations have been completed, a dicision is made in step S50 as to whether throttle opening value $\theta_{ADC}$ is smaller than the minimum of the throttle opening values ("minimum throttle opening value") $\theta_{min}$. If $\theta_{ADC}<\theta_{MIN}$, $\theta_{MIN}$ is updated to $\theta_{ADC}$ in step S51. Since minimum throttle opening value $\theta_{MIN}$ is set to 255 in step S53 (explained later), if $\theta_{ADC}>\theta_{max}$, minimum throttle opening value $\theta_{MIN}$ is the minimum value of throttle opening values during the period in which throttle opening value $\theta_{ADC}$ is kept equal to or smaller than predetermined value $\theta_{max}$.

If it is decided in step S10 that throttle opening value $\theta_{ADC}$ is larger than predetermined value $\theta_{max}$, a decision is made in step S40 as to whether minimum stability value $\theta_{LOW}$ is equal to 255. If NO, a decision is made in step S52 as to whether minimum stability value $\theta_{LOW}$ is equal to minimum throttle opening value $\theta_{MIN}$. If YES, this indicates that $\theta_{LOW}$ is the real minimum stability value during the period in which throttle opening value $\theta_{ADC}$ does not exceed predetermined value $\theta_{max}$. Accordingly, $\theta_{LOW}$ is stored as the real minimum stability value, the operations in steps S41–S47 are executed to update idling position throttle opening value $\theta_{IDL}$ to $\theta_{LOWP}$ and, finally, minimum throttle opening value $\theta_{MIN}$ is set to the maximum value 255 for the preparation of the next detection of the minimum throttle opening value.

After the completion of the operation of step S53, if $\theta_{LOW}$ is unequal to $\theta_{MIN}$ in step S52, if $\theta_{LOW}$ is unequal to 255 in step S40, if it is decided in step S50 that $\theta_{ADC}\geqq\theta_{MIN}$ and after the completion of the operation of step S51, idling position reference-throttle opening value $\theta$ is updated to $(\theta_{ADC}-\theta_{IDL})$ in step S18.

Figure 11:
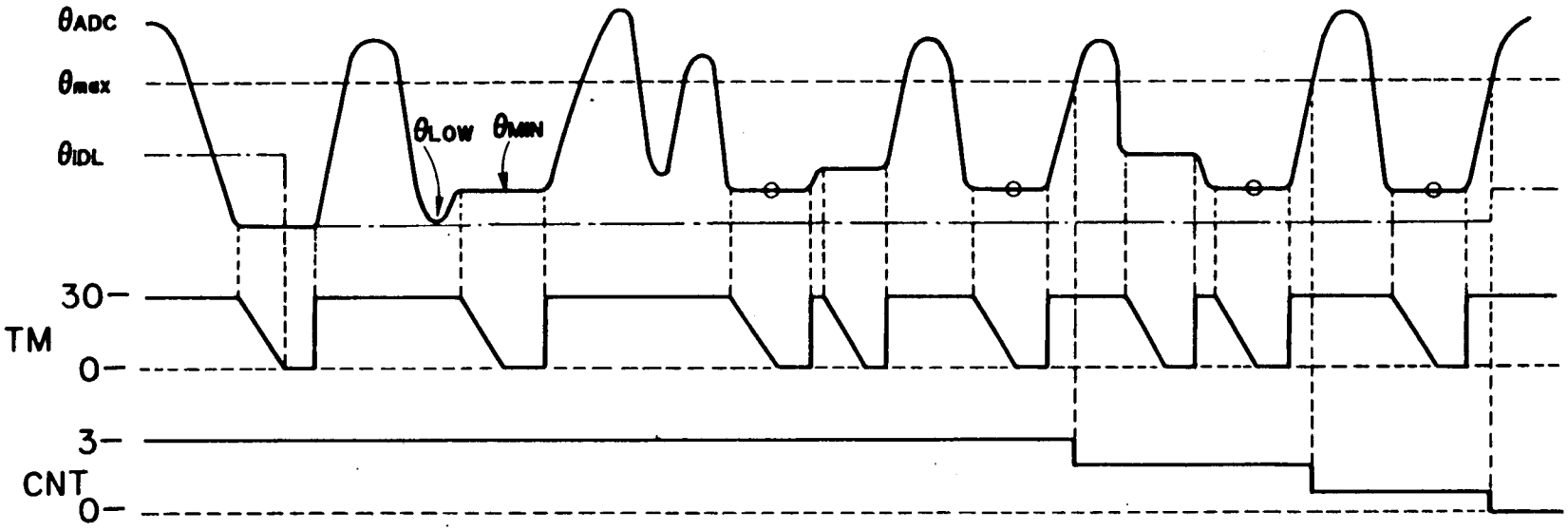
FIG. 11 shows a graph used for explaining the operation of the fourth embodiment.

FIG. 11 shows a time chart for explaining the operation performed in the steps of the fourth embodiment. Similar to the operation of the third embodiment, the counter CNT becomes equal to zero and idling position throttle opening value $\theta_{IDL}$ is updated only if the throttle valve 3 assumes the same opened position four consecutive times. Further, if the throttle valve 3 is returned to the vicinity of an idling position and, immediately after that, is opened slightly and kept in this position, the minimum stability value is different from the minimum throttle opening value. Accordingly, it is possible that there is no necessity of detecting $\theta_{LOW}$ as one of the parameters for detecting an idling position, and, therefore, the possibility of erroneous detection of an idling position becomes lower than that in the third embodiment.

In summary, an apparatus for detecting the degree of opening of a throttle valve of an engine according to the first embodiment can provide a throttle opening signal with reference to an idling position ("zero position") which has been determined and stored as the position of the throttle valve detected when a signal corresponding to the degree of throttle opening is lower than a predetermined value indicating the upper limit of dispersion in an idling position, and is kept unchanged for a fixed interval.

An apparatus for detecting the degree of opening of a throttle valve of an engine according to the second embodiment enables the detection of an idling position by determining that the lower limit of a signal corresponding to the degree of throttle opening indicates an idling position of the throttle valves when a voltage level of the above-described signal is in the vicinity of the boundary of a digital signal to which the above-described signal is converted by the A/D converter 203, and when the digital signal changes within a range of $$\begin{smallmatrix}+1\\0\end{smallmatrix}\ \text{bit}$$

due to noise and fluctuation in the power supply.

An apparatus for detecting the degree of opening of a throttle valve of an engine according to the third embodiment can modify a signal indicating an idling position of the throttle valve in the direction of more opened throttle valve and store a signal corresponding to the modified idling position only if the coincidence of the minimum values of signals corresponding to the throttle opening (the "minimum stability values") at the current time and the preceeding time is found consecutively at predetermined times when the above-described signals are lower than the above-described predetermined value and are kept unchanged for a fixed interval. This makes it possible to reduce the possibility of erroneous detection, as an idling position, a throttle valve position detected when the signal indicating the degree of throttle opening which corresponds to the position of a slightly opened and stabilized throttle valve is lower than the above-described predetermined value.

In an apparatus for detecting the degree of opening of a throttle valve of an engine according to the fourth embodiment, the minimum value of signals corresponds to the degree of throttle opening is detected when these signals are under the predetermined value described above. If this minimum value is unequal to the minimum stability value described above, the minimum stability value can be omitted from the parameters for detecting an idling position because the minimum stability value does not indicate an idling position. This makes it possible to further reduce the possibility of erroneous detection of an idling position.

The invention has been described in detail with particular reference to certain embodiments thereof, but it will be understood that variations and modifications can be effected within the spirit and scope of the invention. For example, a switch which is turned ON or OFF when throttle opening value $\theta_{ADC}$ does not exceed predetermined value $\theta_{max}$ may be provided in a throttle sensor. On the basis of whether this switch is at the ON state or OFF state, a decision can be made as to whether $\theta_{ADC}$ does not exceeds $\theta_{max}$.

Figure 5:
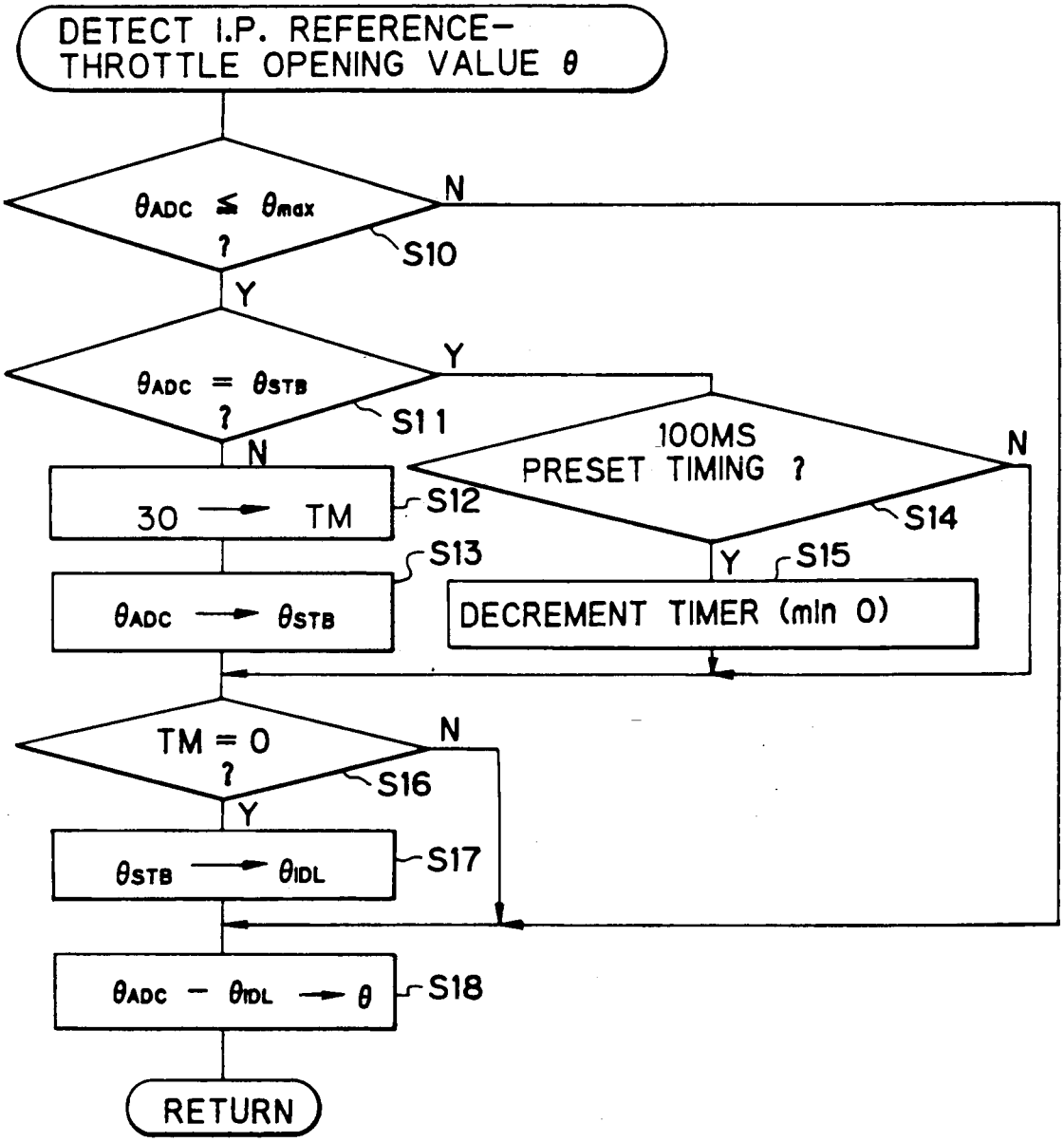
FIG. 5 shows a flowchart of the operations for detecting an idling position reference-throttle opening value in accordance with the first embodiment of the present invention.

It should be noted that steps S30–S32 and S40–S47 executed in the third embodiment can be incorporated into the corresponding portions of the flowchart shown in FIG. 5.

What is claimed is:

1. A apparatus for detecting the degree of opening of a throttle valve of an engine, comprising:

means coupled to the throttle valve for providing a first signal indicating the degree of opening of the throttle valve;

means for detecting the degree of opening of the throttle valve during idling so as to provide a second signal indicating such a position; and means for calculating a value indicating the difference between the first and second signals, whereby the calculated value is used to control an amount of fuel supplied to the engine.

2. An apparatus for detecting the opening of a throttle valve of an engine, comprising:

a first storing means for storing a first value indicating the degree of opening of the throttle valve;

a second storing means for storing a second value indicating the degree of opening of the throttle valve during idling;

means for deciding whether the throttle valve is in an idling position;

means for deciding whether the first value is kept unchanged for a fixed interval when it is decided that the throttle valve is in an idling position;

means for providing a stable value of the first value when it is decided that the first value is kept unchanged for the fixed internal and that the throttle valve is in an idling position;

means for causing the second storing means to update the second value to the stable value; and means for calculating a value indicating the difference between the contents of the first and second storing means, whereby the calculated value is used to control an amount of fuel supplied to the engine.

3. An apparatus as set forth in claim 2 further comprising:

means for detecting and providing the minimum value of the stable values detected during the period in which the throttle valve is in an idling position;

means for deciding whether the minimum, value of the stable values is kept unchanged for a fixed interval when the throttle valve is not in an idling position; and means for causing the second storing means to update the second value to the minimum value of the stable values when it is decided that the minimum value of the stable values is kept unchanged for the fixed interval when the throttle valve is not in an idling position.

4. An apparatus as set forth in claim 3 further comprising:

means for deciding whether the lower limit of the first value is lower than the second value; and means for causing the second storing means to update the second value to the lower limit of the first value.

5. An apparatus as set forth in claim 4 further comprising:

means for detecting and providing the minimum value of the first values during the period in which the throttle value is in an idling position;

means for deciding whether the minimum value of the stable values is kept equal to the minimum value of the first value for a fixed interval; and means for causing the second storing means to update the second value to the minimum value of the stable values when it is decided that the minimum value of the stable values is kept equal to the minimum value of the first values for the fixed interval.

6. An apparatus as set forth in claim 2 further comprising means for deciding whether the first value is kept within a predetermined range for a fixed interval when the throttle valve is in an idling position, and wherein the means for providing a stable value to provide the lower limit of the first value and the second storing means is updated to such a lower limit when it is decided that the first value is kept within the predetermined range for the fixed interval when the throttle valve is in an idling position.

7. An apparatus as set forth in claim 6 further comprising:

means for detecting and providing the minimum value of the stable values detected during the period in which the throttle valve is in an idling position;

means for deciding whether the minimum value of the stable values is kept unchanged for a fixed interval when the throttle valve is not in an idling position; and means for causing the second storing means to update the second value to the minimum value of the stable values when it is decided that the minimum value of the stable values is kept unchanged for the fixed interval when the throttle valve is not in an idling position.

8. An apparatus as set forth in claim 7 further comprising:

means for deciding whether the lower limit of the first value is lower than the second value; and means for causing the second storing means to update the second value to the lower limit of the first value.

9. An apparatus as set forth in claim 8 further comprising:

means for detecting and providing the minimum value of the first values during the period in which the throttle value is in an idling position;

means for deciding whether the minimum value of the stable values is kept equal to the minimum value of the first values for a fixed interval; and means for causing the second storing means to update the second value to the minimum value of the stable values when it is decided that the minimum value of the stable values is kept equal to the minimum value of the first values for the fixed interval.

* * * * *